US007308926B1

(12) United States Patent
Hawkins

(10) Patent No.: US 7,308,926 B1
(45) Date of Patent: Dec. 18, 2007

(54) R AND R SECURITY SCREEN GARAGE DOOR

(76) Inventor: Raymond Hawkins, 16880 Mission St., Hesperia, CA (US) 92345

( * ) Notice: Subject to any disclaimer, the term of this patent is extended or adjusted under 35 U.S.C. 154(b) by 363 days.

(21) Appl. No.: 11/073,280

(22) Filed: Mar. 4, 2005

Related U.S. Application Data

(60) Provisional application No. 60/550,063, filed on Mar. 5, 2004.

(51) Int. Cl.
*E05D 15/18* (2006.01)

(52) U.S. Cl. ..... 160/113; 160/201

(58) Field of Classification Search ..... 160/113, 160/201, 117, 118, 209; 292/45, 48, 66, 292/137, 242, DIG. 36
See application file for complete search history.

(56) References Cited

U.S. PATENT DOCUMENTS 3,103,967 A * 9/1963 Leon ..... 160/113
4,653,566 A * 3/1987 Miale ..... 160/201
5,050,660 A * 9/1991 Bleichwehl et al. ..... 160/113
5,408,789 A * 4/1995 Plfeger ..... 52/173.2
5,535,802 A 7/1996 Chambers
5,611,382 A * 3/1997 Sferra ..... 160/113
5,848,630 A 12/1998 Manzo
5,860,465 A * 1/1999 Eastridge et al. ..... 160/113
6,053,235 A 4/2000 Ruffner, Sr.
6,092,580 A * 7/2000 Lucas ..... 160/113
6,289,963 B1 * 9/2001 Vaske ..... 160/89
6,557,614 B1 * 5/2003 Lampers ..... 160/113
7,086,442 B1 * 8/2006 Esparza ..... 160/113

* cited by examiner

*Primary Examiner*—David Purol

(57) ABSTRACT

A screen door that can be utilized in conjunction with an electronic garage door. The screen door can be attached or detached from the garage door and has the same size and shape as the garage door. The screen door runs up and down on its own set of tracks and has no power of its own to go up or down.

2 Claims, 2 Drawing Sheets

R AND R SECURITY SCREEN GARAGE DOOR

I. CROSS-REFERENCE TO RELATED APPLICATIONS

This application claims the benefit of U.S. Provisional Application No. 60/550,063, filed Mar. 5, 2004.

II. BACKGROUND OF THE INVENTION

The present invention concerns that of a new and improved screen door that can be utilized in conjunction with an electronic garage door.

III. DESCRIPTION OF THE PRIOR ART

U.S. Pat. No. 6,053,235, issued to Ruffner Sr., discloses a screen door closure for a garage door to allow for use of the garage as a workspace while serving as a barrier to insects.

U.S. Pat. No. 5,848,630, issued to Manzo, discloses a garage door with a secondary security door comprised of multiple panels of wire mesh material to allow for the free flow of air while preventing unwanted intruders.

U.S. Pat. No. 5,535,802, issued to Chambers, discloses an automatic garage door comprised of a series of hinged and interconnected panels used with screen closures for use in warm climates.

IV. SUMMARY OF THE INVENTION

The present invention concerns that of a new and improved screen door that can be utilized in conjunction with an electronic garage door. The screen door can be attached or detached from the garage door and has the same size and shape as the garage door. The screen door runs up and down on its own set of tracks and has no power of its own to go up or down.

There has thus been outlined, rather broadly, the more important features of a screen door that the detailed description thereof that follows may be better understood and in order that the present contribution to the art may be better appreciated. There are, of course, additional features of the screen door that will be described hereinafter and which will form the subject matter of the claims appended hereto.

In this respect, before explaining at least one embodiment of the screen door in detail, it is to be understood that the screen door is not limited in its application to the details of construction and to the arrangements of the components set forth in the following description or illustrated in the drawings. The screen door is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present screen door. It is important, therefore, that the claims be regarded as including such equivalent constructions insofar as they do not depart from the spirit and scope of the present invention.

It is therefore an object of the present invention to provide a screen door which has all of the advantages of the prior art and none of the disadvantages.

It is another object of the present invention to provide a screen door which may be easily and efficiently manufactured and marketed.

It is another object of the present invention to provide a screen door which is of durable and reliable construction.

It is yet another object of the present invention to provide a screen door which is economically affordable and available for relevant market segment of the purchasing public.

Other objects, features and advantages of the present invention will become more readily apparent from the following detailed description of the preferred embodiment when considered with the attached drawings and appended claims.

V. BRIEF DESCRIPTION OF THE DRAWINGS

VI. DESCRIPTION OF THE PREFERRED EMBODIMENT

Figure 1:
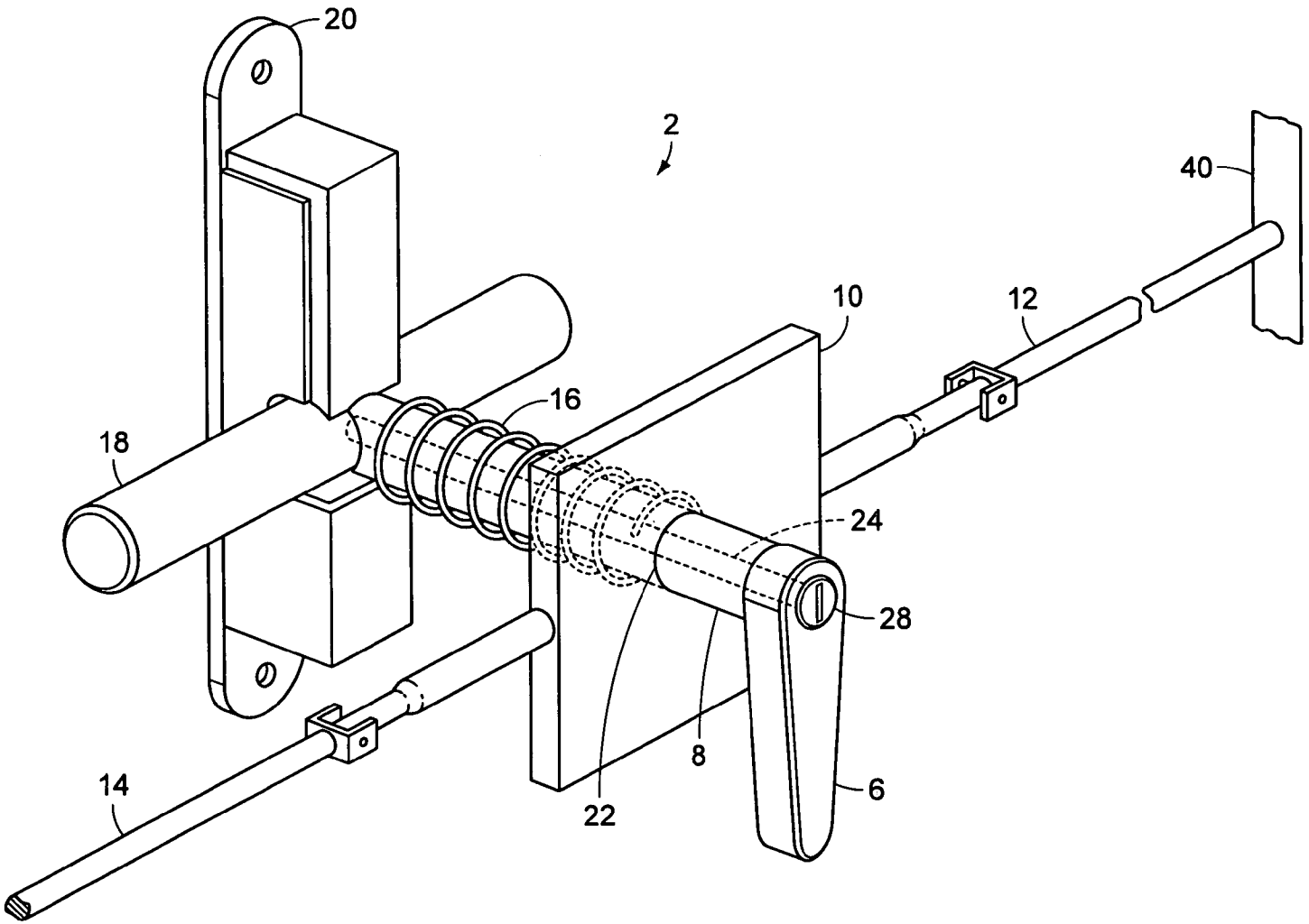
FIG. 1 shows a perspective close-up view of the connector handle that is associated with the screen door.

FIG. 1 shows a perspective close-up view of the connector handle 2 that is associated with the screen door 4. Connector handle 2 itself comprises a handle 6, an outer casing 8, a mounting plate 10, support rods 12 and 14, spring 16, mounting bar 18, and mounting bar bracket 20.

Only a portion of screen door 4 is shown in FIG. 1 to show the proper connectivity between the connector handle 2 and the screen door 4. Screen door 4 has two ends, a left end and a right end, and furthermore, has two sides, a top side and a bottom side. Screen door 4 also has two surfaces, an outer surface and an inner surface. Mounting plate 10 is attached to the screen door in approximately halfway between the left end and the right end, with the mounting plate being closer to the bottom side than the top side of the screen door 4. The mounting plate 10 serves to mount the remaining portions of the connector handle 2.

Mounting plate 10 has a centrally located hole 22 through which outer casing 8 is mounted within. Outer casing 8 has two ends, a first end and a second end, with the first end of the outer casing 8 sticking out of the mounting plate 10 and the second end of the outer casing being located past the inner surface of the screen door 4. Within outer casing 8 is placed handle rod 24, which has two ends, a first end and a second end. The first end of the handle rod 24 is connected to handle 6, which allows handle to be freely rotatable.

Support rods 12 and 14 are attached to the mounting plate 10 and are designed to each attach to a portion of the frame 40 of the screen door 4. Each of the support rods 12 and 14 are horizontal and connect to the frame 40 on opposite ends of the screen door 4, with support rod 12 attaching to the left end of the screen door 4 and support rod 14 attaching to the right end of the screen door 4.

Mounting bar 18 is attached to the second end of the handle rod 24 at a ninety degree angle. Mounting bar 18 itself has two ends, a first end and a second end, and is attached to the second end of the handle rod 24 at the midpoint between its two ends. Mounting bar bracket 20 is designed to both hold mounting bar is a fixed position, once the handle 6 is properly rotated, and is also designed to allow an individual to rotate the handle 6 and remove the mounting bar 18 from the mounting bar bracket 18 by rotating the mounting bar 18 ninety degrees. Mounting bar bracket 20 is itself fixedly attached to a panel on the garage door 42.

Spring 16 is attached to the handle rod 24 in between the second end of the outer casing 8 and the location of the mounting bar 18. When an individual pulls on the handle 6 so that he or she may change the position of the mounting bar 18, the spring 16 is squeezed inward. When an individual releases the handle, the spring 16 acts to push the handle 8 and the mounting bar 18 in opposing directions, thereby making sure that the mounting bar 18 is properly positioned within the mounting bar bracket 20.

Handle 6 also has a key lock 28 mounted on it. Key lock 28 will allow an individual to lock the handle 6 so it can not be used without the benefit of a key.

Figure 2:
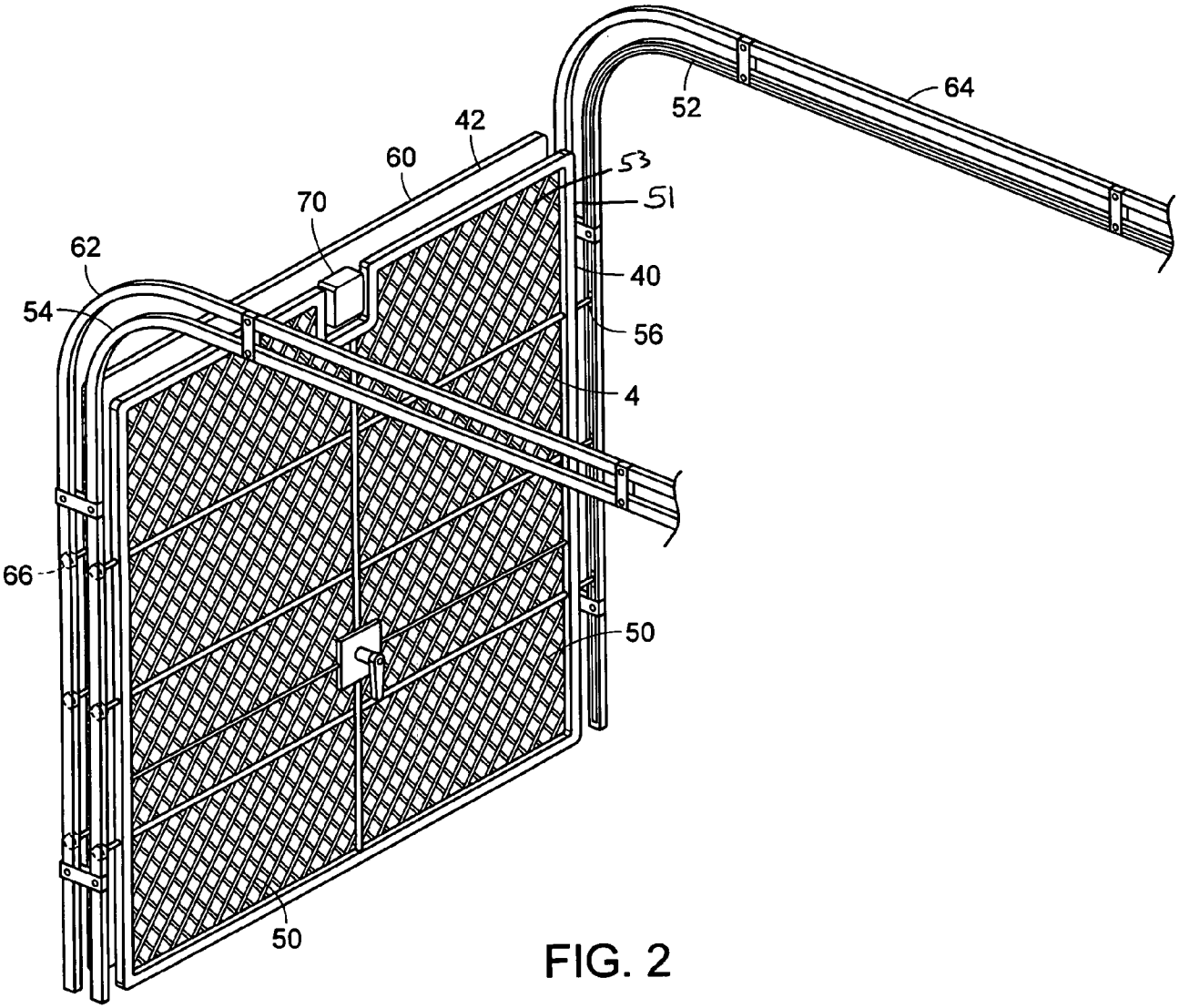
FIG. 2 shows a perspective view of the screen door as it would appear in use in conjunction with a garage door.

FIG. 2 shows a perspective view of the screen door 4 as it would appear in use in conjunction with a garage door 42. Screen door 4 has a plurality of panels 50 which are rectangular in shape and which are pivotally attached to one another. Each panel has an outer frame 51 and has an incorporated screen 53 attached to the outer frame 51.

Although screen door 4 is shown in FIG. 2 to have four panels 50, an actual screen door 4 could have more or less, depending on a variety of factors. Screen door 4 is mounted on tracks 52 and 54 by a plurality of roller wheels 56.

In FIG. 2, garage door 42 also is fabricated from a plurality of panels 60 which are rectangular in shape and which are pivotally attached to one another. Although garage door 42 is shown in FIG. 2 to have four panels 60, an actual garage door 42 could have more or less, depending on a variety of factors. Garage door 42 is mounted on tracks 62 and 64 by a plurality of roller wheels 66.

Usually, the garage door opener system 70 associated with a garage door is only connected to the garage door 42, thereby pulling it up or down as desired by a person. If the mounting bar 18 is located within the mounting bar bracket 20 when an individual attempts to open the garage door 42, then the screen door 4 will also open, sliding upward on its own pair of tracks 52 and 54. If, however, an individual wishes to have his screen door 4 closed but his garage door 42 open, then an individual would remove the mounting bar 18 from the mounting bar bracket 20 prior to opening the garage, thereby preventing the screen door 4 from "riding along" with the garage door 42. In such a situation, the screen door 4 remains shut while the regular garage door 42 opens up.

What I claim as my invention is:

1. A security screen door for use in conjunction with a garage door, the garage door comprising a plurality of panels pivotally attached to one another, the garage door being connected to a pair of tracks, the security screen door having two ends comprising a first end and a second end, the security screen door further having two sides, a first side and a second side, the security screen door further having two surfaces, an outer surface and an inner surface, the security screen door further comprising:

a plurality of panels, each of the panels being rectangular in shape, the panels being pivotally attached to one another, each panel comprising an outer frame, a plurality of screens, each screen being located within the outer frame of a panel, a pair of tracks, each of the tracks of the pair of tracks being located adjacent to a track of the pair of tracks of the garage door, a plurality of roller wheels, the roller wheels being used to mount the panels onto the pair of tracks, and means for connecting the security screen door to the garage door, wherein the means for connecting the security screen door to the garage door further comprises:

a mounting plate attached to the screen door, a hole located in the mounting plate, an outer casing having a first end and a second end, with the first end of the outer casing sticking out of the mounting plate and the second end of the outer casing being located past the inner surface of the screen door, a handle rod having a first end and a second end, the handle rod being located within the outer casing, a handle attached to the first end of the handle rod, a pair of support rods comprising a first support rod and a second support rod, each of the support rods being horizontally positioned and connected to the outer frame of the security screen door, wherein the first support rod connects to the left end of the security screen door and further wherein the second support rod connects to the right end of the security screen door, a mounting bar having a first end and a second end, the mounting bar being attached to the second end of the handle rod at a ninety degree angle, the mounting bar being attached to the second end of the handle rod about halfway between the first end of the mounting bar and the second end of the mounting bar, a mounting bar bracket fixedly attached to a panel on the garage door, and a spring attached to the handle rod in between the second end of the outer casing and the location of the mounting bar, wherein when an individual pulls on the handle and changes the position of the mounting bar the spring is squeezed inward further wherein an individual releases the handle, the spring acts to push the handle and the mounting bar in opposing directions thereby making sure that the mounting bar is properly positioned within the mounting bar bracket.

2. A security screen door for use in conjunction with a garage door according to claim 1 wherein the security screen door further comprises a key lock, the key lock being attached to the handle.

* * * * *